US010458060B2

(12) United States Patent
Shelton et al.

(10) Patent No.: US 10,458,060 B2
(45) Date of Patent: Oct. 29, 2019

(54) ROTATABLE IRONING BOARD ASSEMBLY

(71) Applicants: John Shelton, Indianapolis, IN (US); Veaon Shelton, Indianapolis, IN (US)

(72) Inventors: John Shelton, Indianapolis, IN (US); Veaon Shelton, Indianapolis, IN (US)

( * ) Notice: Subject to any disclaimer, the term of this patent is extended or adjusted under 35 U.S.C. 154(b) by 0 days.

(21) Appl. No.: 15/883,152

(22) Filed: Jan. 30, 2018

(65) Prior Publication Data

US 2019/0234007 A1 Aug. 1, 2019

(51) Int. Cl.
*D06F 81/00* (2006.01)

(52) U.S. Cl.
CPC ..... *D06F 81/00* (2013.01)

(58) Field of Classification Search
CPC ... D06F 81/00–12; A47B 57/00; A47B 81/00; A47B 23/04; A47B 23/001; A47B 9/00; E04G 3/00
USPC ..... D32/66
See application file for complete search history.

(56) References Cited

U.S. PATENT DOCUMENTS 2,678,084 A * 5/1954 Sykes ..... A47B 83/00 182/33
2,680,314 A 6/1954 Snyder
4,049,332 A * 9/1977 Boudreaux ..... A47B 77/08 108/33
4,480,556 A 11/1984 Wilson et al.
4,536,978 A * 8/1985 Cerutti ..... D06F 81/08 38/103
5,915,659 A * 6/1999 Scannell, Jr. ..... A47B 9/08 108/10
D514,766 S * 2/2006 Manfiotto ..... D32/66
7,062,871 B1 * 6/2006 Smidt ..... A47B 77/10 108/35
D543,672 S 5/2007 Chu
7,546,810 B2 6/2009 Hernandez
8,266,830 B2 9/2012 Ma et al.
8,272,153 B2 9/2012 Elizondo, Jr.
8,893,411 B2 * 11/2014 Cocksedge ..... D06F 81/10 108/116
9,271,569 B2 3/2016 Zaccai et al.

FOREIGN PATENT DOCUMENTS

FR 2695145 A1 * 3/1994
WO WO2007004135 1/2007
WO WO 2014076728 A2 * 5/2014
WO WO 2014163388 A1 * 10/2014

* cited by examiner

*Primary Examiner* — Ismael Izaguirre

(57) ABSTRACT

A rotatable ironing board assembly for ironing while in a seated position includes a post that has an upper end and a lower end. A rolling unit is attached to the lower end of the post to facilitate movement of the post. A base is pivotally coupled to the upper end of the post. The base is positionable in a stored position that is vertically orientated and pivotable into a deployed position is horizontally orientated. A plate is rotatably coupled to the base. An ironing board is attached to the plate. A catch is attached to and extends outwardly from the post. The catch releasably engages the ironing board when the ironing board is in a vertical orientation.

11 Claims, 6 Drawing Sheets

ROTATABLE IRONING BOARD ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to ironing surfaces and more particularly pertains to a new ironing surface for ironing while in a seated position.

BRIEF SUMMARY OF THE INVENTION

An embodiment of the disclosure meets the needs presented above by generally comprising a post that has an upper end and a lower end. A rolling unit is attached to the lower end of the post to facilitate movement of the post. A base is pivotally coupled to the upper end of the post. The base is positionable in a stored position that is vertically orientated and pivotable into a deployed position is horizontally orientated. A plate is rotatably coupled to the base. An ironing board is attached to the plate. A catch is attached to and extends outwardly from the post. The catch releasably engages the ironing board when the ironing board is in a vertical orientation.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
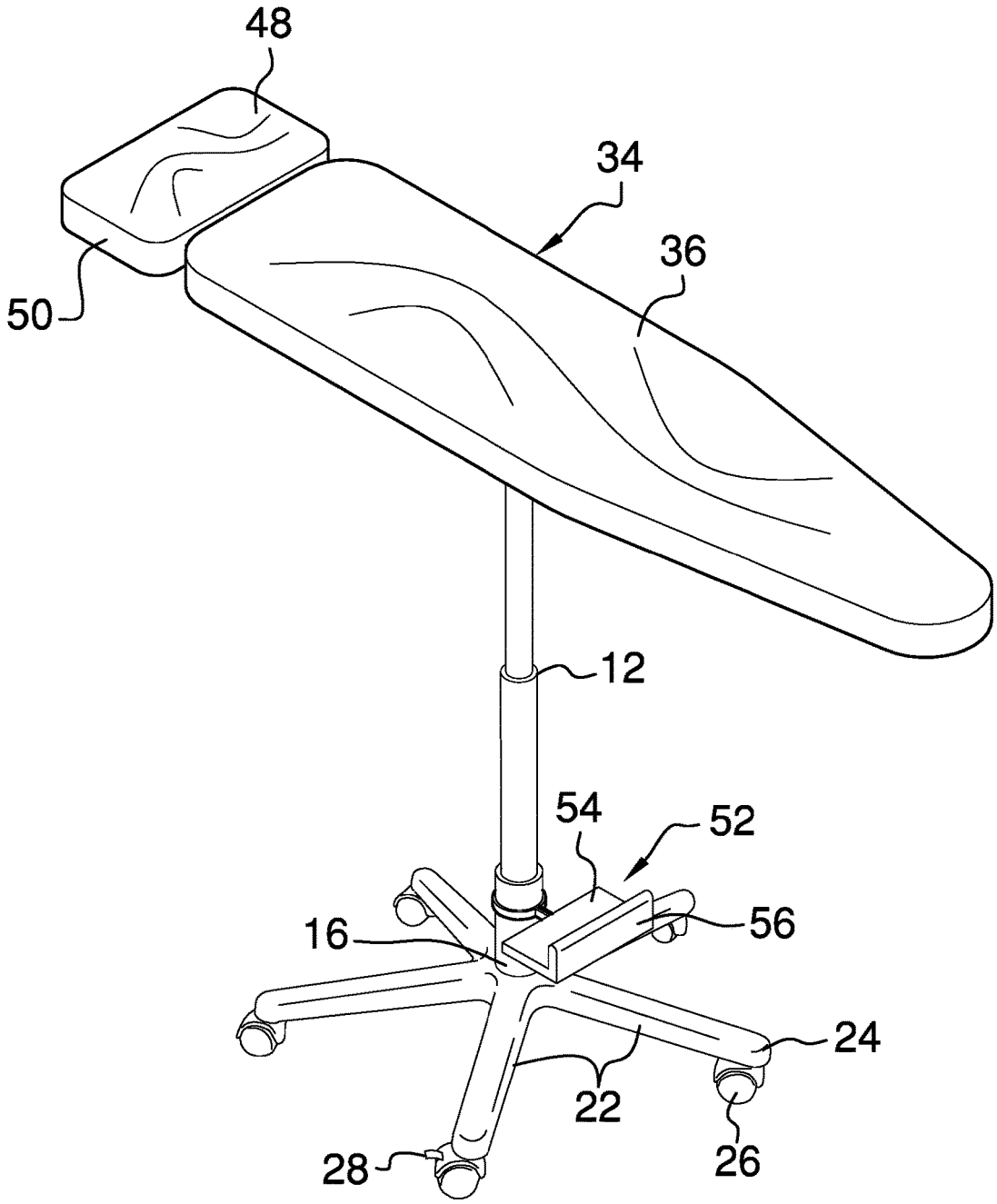
FIG. 1 is a top side view of a rotatable ironing board assembly according to an embodiment of the disclosure.
Figure 2:
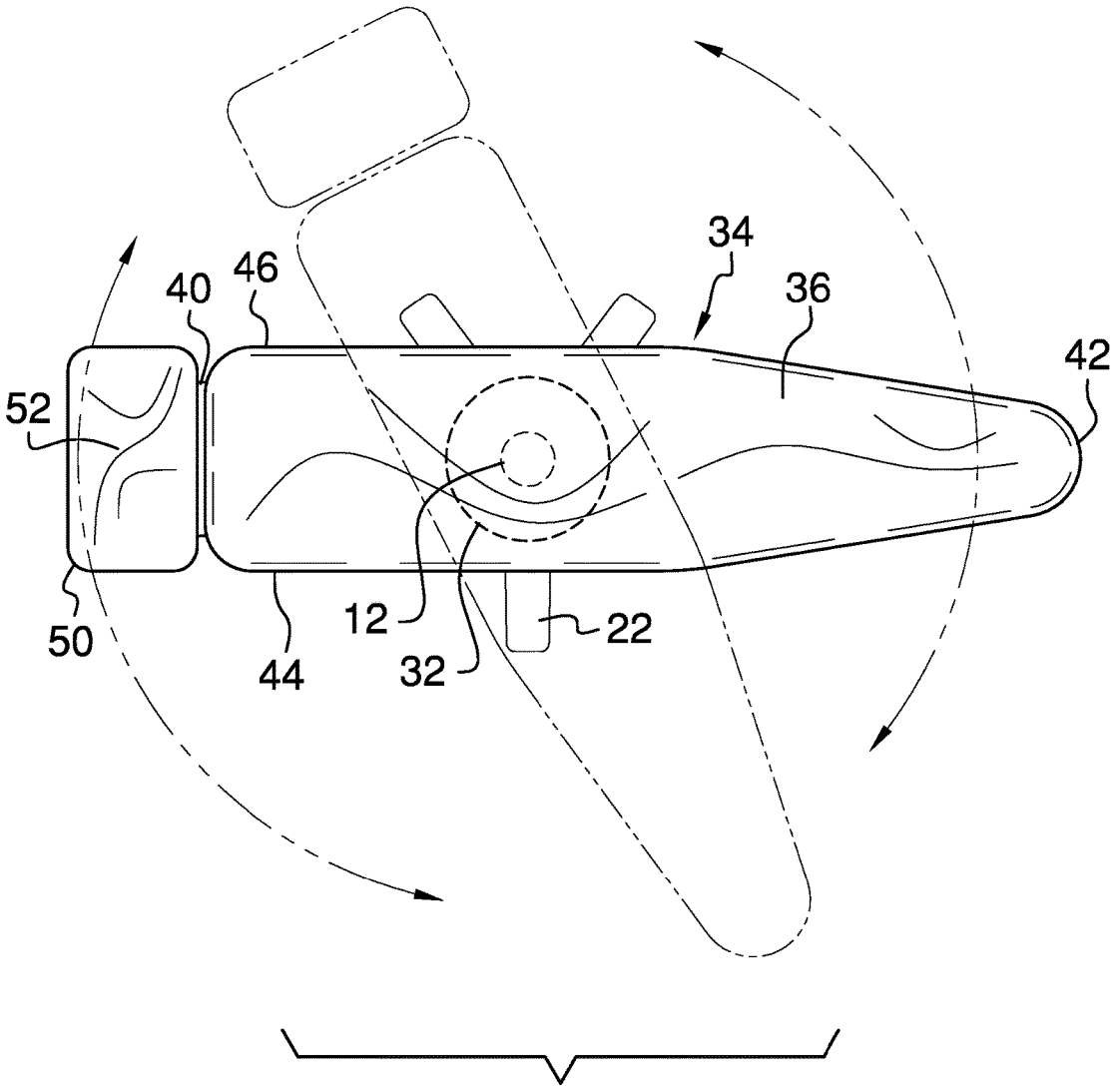
FIG. 2 is a top view of an embodiment of the disclosure.
Figure 3:
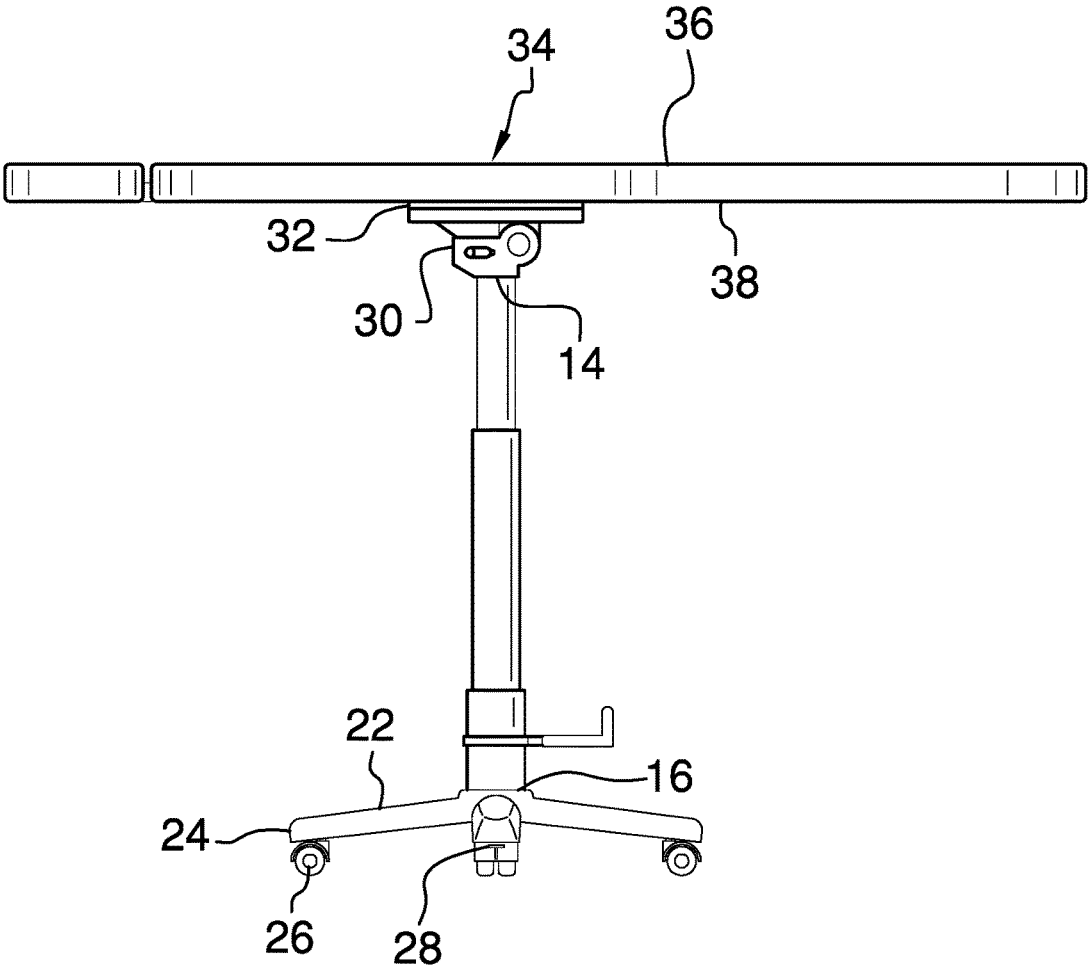
FIG. 3 is a front view of an embodiment of the disclosure.
Figure 4:
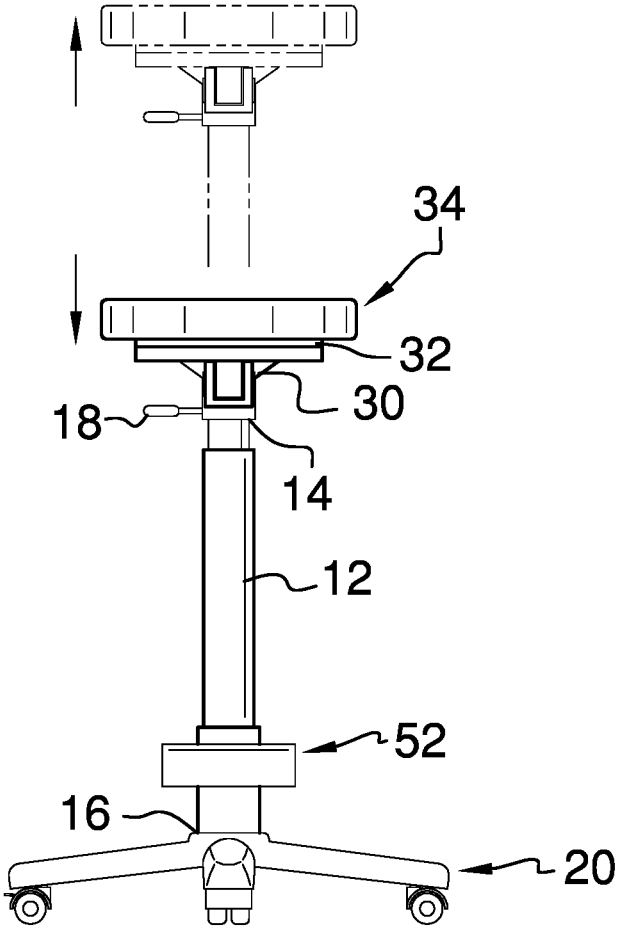
FIG. 4 is a side view of an embodiment of the disclosure.
Figure 5:
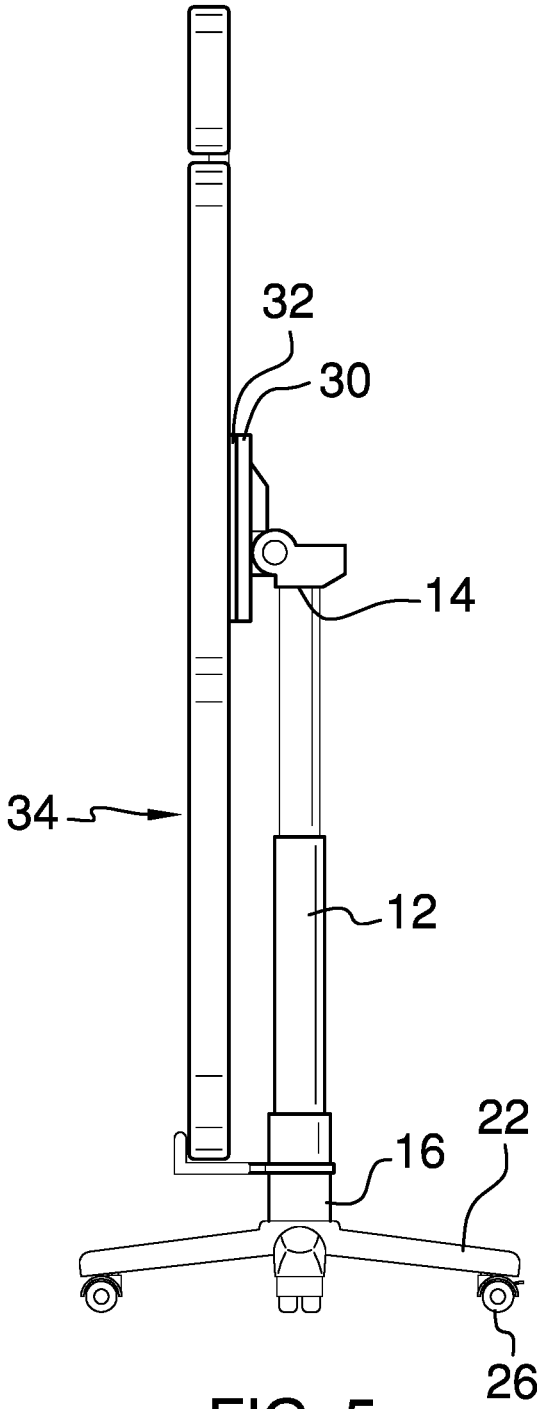
FIG. 5 is a front view of an embodiment of the disclosure.
Figure 6:
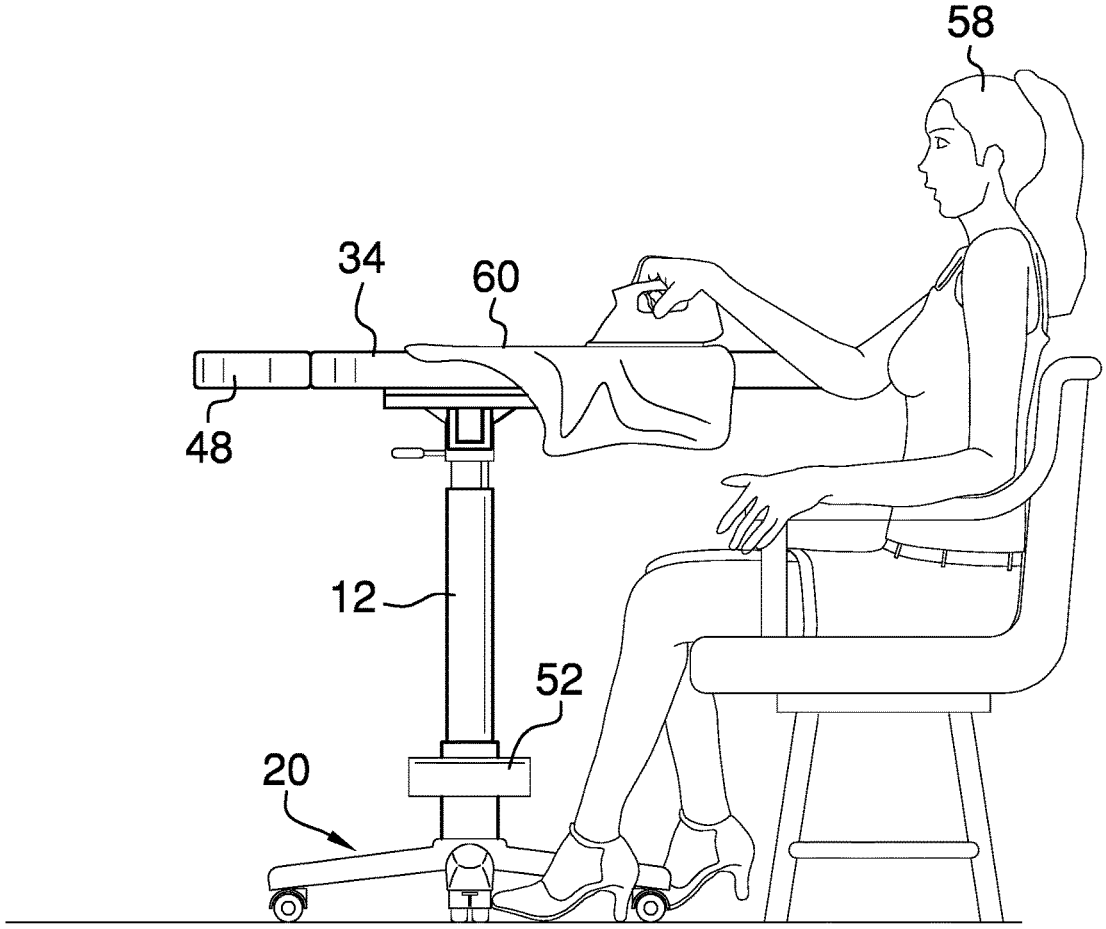
FIG. 6 is a side view of an embodiment of the disclosure.

With reference now to the drawings, and in particular to FIGS. 1 through 6 thereof, a new ironing surface embodying the principles and concepts of an embodiment of the disclosure and generally designated by the reference numeral 10 will be described.

As best illustrated in FIGS. 1 through 6, the rotatable ironing board assembly 10 generally comprises a post 12 that has an upper end 14 and a lower end 16. The post 12 is telescopic and has an adjustable height. The post 12 may have a lever 18 mechanically coupled to a hydraulic cylinder within the post 12. The lever is actuated to adjust the height of the post 12. However, the post 12 may have other mechanisms for adjusting the height thereof such as the use of a locking pin.

A rolling unit 20 is attached to the lower end 16 of the post 12 to facilitate movement of the post 12. The rolling unit 20 includes a plurality of feet 22 wherein each of the feet 22 is attached to the lower end 16 of the post 12 and extends outwardly therefrom. Additionally, each of the feet 22 has a distal end 24 relative to the post.

A plurality of rollers 26 is included in the rolling unit 20. Each of the feet 22 has one of the rollers 26 rotatably attached thereto. Each of the rollers 26 is positioned adjacent to an associated one of the distal ends 24. A lock 28 is positioned on one of the rollers 26 wherein the lock 28 is actuatable to a locked position to inhibit the roller 26 from rotating.

A base 30 is pivotally coupled to the upper end 14 of the post 12. The base 30 is positionable in a stored position that is vertically orientated and pivotable into a deployed position is horizontally orientated. A plate 32 is rotatably coupled to the base 30. The plate 32 extends upwardly from the base 30 when the base 30 is in the deployed position.

An ironing board 34 is attached to the plate 32 and has an upper surface 36, a lower surface 38, a first end 40, a second end 42, a first lateral edge 44 and a second lateral edge 46. The lower surface 38 of the ironing board 34 is attached to the plate 32. The upper surface 36 is statically co-planar with the base 30 such that the upper surface 36 is vertically orientated when the base 30 is vertically orientated.

An iron holder 48 is included and has a peripheral wall 50 that is attached to and extends away from the first end 40 of the ironing board 34. A catch 52 is attached to and extends outwardly from the post 12. The catch 52 releasably engages the ironing board 34 when the ironing board 34 is in a vertical orientation. The catch 52 includes a leg portion 54 that is attached to a foot portion 56. The leg portion 54 is attached to and extends away from the post 12 adjacent to the rolling unit 20. The ironing board 34 is positionable between the foot portion 56 and the post 12 to retain the ironing board 34 in the vertical orientation.

In use, the height of the post 12 is adjusted to accommodate the user 58. The ironing board 34 is set in the horizontal orientation. The user 58 irons an article of clothing 60 on the upper surface 36 of the ironing board 34. The ironing board 34 is rotated to easily reach the entirety of the article of clothing 60.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. An ironing board assembly comprising:

a post having an upper end and a lower end;

a rolling unit being attached to said lower end of said post to facilitate movement of said post;

a base being pivotally coupled to said upper end of said post, said base being positioned in a stored position being vertically orientated and pivotable into a deployed position being horizontally orientated;

a plate being rotatably coupled to said base;

an ironing board being attached to said plate; and a catch being attached to and extending laterally outward from said post, said catch releasably engaging said ironing board when said ironing board is in a vertical orientation, said catch including a leg portion attached to a foot portion, said leg portion being attached to and extending away from said post adjacent to said rolling unit, said ironing board being positionable between said foot portion and said post to retain said ironing board in said vertical orientation.

2. The ironing board assembly according to claim 1, wherein said post is telescopic and has an adjustable height.

3. The ironing board assembly according to claim 1, wherein said rolling unit includes a plurality of feet, each of said feet being attached to said lower end of said post and extending outwardly therefrom, each of said feet having a distal end relative to said post.

4. The ironing board assembly according to claim 3, wherein said rolling unit further includes a plurality of rollers, each of said feet having one of said rollers rotatably attached thereto.

5. The ironing board assembly according to claim 4, wherein each of said rollers is positioned adjacent to an associated one of said distal ends.

6. The ironing board assembly according to claim 4, wherein said rolling unit further includes a lock being positioned on one of said rollers, said lock being actuatable to a locked position to inhibit said roller from rotating.

7. The ironing board assembly according to claim 1, wherein said plate extends upwardly from said base when said base is in said deployed position.

8. The ironing board assembly according to claim 1, wherein said ironing board has an upper surface, a lower surface, a first end, a second end, a first lateral edge and a second lateral edge, said lower surface being attached to said plate.

9. The ironing board assembly according to claim 8, wherein said upper surface is statically co-planar with said base such that said upper surface is vertically orientated when said base is vertically orientated.

10. The ironing board assembly according to claim 8, further including an iron holder having a peripheral wall being attached to and extending away from said first end of said ironing board.

11. An ironing board assembly comprising:

a post having an upper end and a lower end, said post being telescopic and having an adjustable height;

a rolling unit being attached to said lower end of said post to facilitate movement of said post, said rolling unit including:

a plurality of feet, each of said feet being attached to said lower end of said post and extending outwardly therefrom, each of said feet having a distal end relative to said post;

a plurality of rollers, each of said feet having one of said rollers rotatably attached thereto, each of said rollers being positioned adjacent to an associated one of said distal ends;

a lock being positioned on one of said rollers, said lock being actuatable to a locked position to inhibit said roller from rotating;

a base being pivotally coupled to said upper end of said post, said base being positioned in a stored position being vertically orientated and pivotable into a deployed position being horizontally orientated;

a plate being rotatably coupled to said base, said plate extending upwardly from said base when said base is in said deployed position;

an ironing board being attached to said plate, said ironing board having an upper surface, a lower surface, a first end, a second end, a first lateral edge and a second lateral edge, said lower surface being attached to said plate, said upper surface being statically co-planar with said base such that said upper surface is vertically orientated when said base is vertically orientated;

an iron holder having a peripheral wall being attached to and extending away from said first end of said ironing board; and a catch being attached to and extending laterally outward from said post, said catch releasably engaging said ironing board when said ironing board is in a vertical orientation, said catch including a leg portion attached to a foot portion, said leg portion being attached to and extending away from said post adjacent to said rolling unit, said ironing board being positionable between said foot portion and said post to retain said ironing board in said vertical orientation.

* * * * *